US010210731B2

(12) United States Patent
Persici et al.

(10) Patent No.: US 10,210,731 B2
(45) Date of Patent: Feb. 19, 2019

(54) SYSTEMS AND METHODS FOR A SMART ELECTRONIC ARTICLE SURVEILLANCE CIRCUIT

(71) Applicant: Datalogic IP Tech, S.r.l., Bologna (IT)

(72) Inventors: William Persici, Bologna (IT); Andrea Belli, Bologna (IT); Filippo Dalbagno, San Lazzaro (IT)

(73) Assignee: DATALOGIC IP TECH, S.R.L., Bologna (IT)

( * ) Notice: Subject to any disclaimer, the term of this patent is extended or adjusted under 35 U.S.C. 154(b) by 0 days.

(21) Appl. No.: 15/636,330

(22) Filed: Jun. 28, 2017

(65) Prior Publication Data

US 2019/0005792 A1 Jan. 3, 2019

(51) Int. Cl.
*G08B 13/24* (2006.01)

(52) U.S. Cl.
CPC ..... *G08B 13/2431* (2013.01); *G08B 13/2414* (2013.01); *G08B 13/2477* (2013.01)

(58) Field of Classification Search
CPC ..... G08B 13/2431; G08B 13/2414; G08B 13/2477
USPC ..... 340/572.1
See application file for complete search history.

(56) References Cited

U.S. PATENT DOCUMENTS

2006/0202835 A1* 9/2006 Thibault ..... A01K 11/004 340/573.1
2009/0066516 A1* 3/2009 Lazo ..... G06K 19/0724 340/572.7
2009/0115674 A1 5/2009 Fujieda et al.
2013/0105584 A1* 5/2013 Forster ..... G06K 19/0723 235/492
2015/0116178 A1 4/2015 Kim et al.
2015/0159656 A1 6/2015 Urabe et al.
2016/0086188 A1* 3/2016 Candelore ..... G06Q 20/425 705/44

FOREIGN PATENT DOCUMENTS

| | | |
|---|---|---|
| CN | 204331741 U | 5/2015 |
| EP | 2774084 | 9/2014 |
| WO | WO-2008045570 | 4/2008 |
| WO | WO-2006057888 | 6/2008 |
| WO | 2017/063136 A1 | 4/2017 |

* cited by examiner

*Primary Examiner* — Kerri L McNally
(74) *Attorney, Agent, or Firm* — Cozen O'Connor

(57) ABSTRACT

Systems and methods for a smart electronic article surveillance ("EAS") circuit that may be incorporated into electronic devices and used to selectively provide EAS and other functionalities. Such functionalities may be provided by "sharing" large electrical components across the different functionalities, which may include passive EAS capabilities, inductive charging, and/or wireless communications. One or more software or solid-state switches may be used to selectively and repeatedly change between the wireless communication/inductive charging capabilities and the passive EAS capabilities. The EAS functionality may be provided by using a switch to connect passive circuitry across an antenna component to form a passive EAS circuit. The non-EAS functionality may be provided by using the switch to decouple the passive circuitry from then antenna and instead, couple the antenna to other electronic circuitry.

17 Claims, 6 Drawing Sheets

SYSTEMS AND METHODS FOR A SMART ELECTRONIC ARTICLE SURVEILLANCE CIRCUIT

TECHNICAL FIELD

The present disclosure relates to electronic article surveillance (EAS) circuits, including EAS circuits having components that may be selectively used in circuits providing other EAS and other functionalities.

BACKGROUND

Description of the Related Art

Electronic devices offer numerous capabilities and features to enhance a user's experience and improve the device's functionality. These features include, for example, various types of near field communication (NFC) capabilities as well as wireless charging capabilities, such as may be achieved via inductive coupling.

In an unrelated field, retailers and/or manufacturers may have an incentive to employ anti-theft system, for example to minimize potential losses attributable to stolen products. Such an anti-theft system may take the form of an electronic article surveillance (EAS) system in which EAS tags are typically adhered to, or otherwise incorporated in, packaging of products. A number of antennas are positioned at exits and, or entrances of a monitored space, for example a retail location. A transceiver, coupled to the antennas, detects the presence of any EAS tags that have not been deactivated, and typically produce an alert in response to a detection. In use, on purchase of goods by a customer, a store clerk typically deactivates the EAS tag associated with the purchased goods. The deactivation may include physical, electrically or magnetically rendering the EAS tag inoperable. Typically, a deactivated EAS tag cannot later be reactivated.

BRIEF SUMMARY

Because of the small size of many electronic devices, using one or more electrical components for multiple purposes or functionalities may be advantageous, especially for electrical components that are relatively bulky or expensive when compared to the other components in the electronic device. For example, both NFC and wireless charging functionalities may use a large inductive coil that may act as an inductor. Such a coil, however, may also be used as a part of a passive EAS circuit that may be included within the electronic device.

An electronic device may be summarized as including a set of circuitry, the set of circuitry comprising at least one of: a power supply circuit that provides wireless charging of a battery, or a transceiver, transmitter or receiver that provides wireless communications; an antenna; a first passive circuitry; and a first switch having a first state and a second state, the first switch selectively operable to electrically couple the first passive circuitry across the antenna in the first state of the first switch and to electrically decouple the first passive circuitry from across the antenna in the second state of the first switch, wherein, in the first state of the first switch the antenna and the first passive circuitry form a passive electronic article surveillance (EAS) circuit with a first resonant frequency and in the second state of the first switch the set of circuitry and the antenna form at least one of an inductive charger or a radio with a respective resonant frequency that is different from the first resonant frequency.

The first resonant frequency may be in a range from 1.75 MHz to 9.5 MHz. The second resonant frequency may be in a range from 80 kHz to 300 kHz. The set of circuitry may include a near field communications (NFC) receiver that provides authentication of transactions with other electronic devices. The set of circuitry may include a near field communications (NFC) integrated circuit. The second resonant frequency may be about 13.56 MHz.

The electronic device may further include the battery. The second resonant frequency may be in a range from 80 kHz to 300 kHz.

The electronic device may further include a second passive circuitry; and a second switch having a first state and a second state, the second switch selectively operable to electrically couple the second passive circuitry across the antenna in the first state of the second switch and to electrically decouple the second passive circuitry from across the antenna in the second state of the second switch, wherein, when the first switch is in the first state and the second switch is in the first state the antenna and the first passive circuitry and the second passive circuitry form a passive EAS circuit with a second resonant frequency, the second resonant frequency different than the first resonant frequency.

The electronic device may further include a third passive circuitry; and a third switch having a first state and a second state, the third switch selectively operable to electrically couple the third passive circuitry across the antenna in the first state of the second switch and to electrically decouple the third passive circuitry from across the antenna in the second state of the second switch, wherein, when the first switch is in the first state, the second switch is in the first state, and the third switch is in the first state, the antenna and the first passive circuitry, the second passive circuitry, and the third passive circuitry form a passive EAS circuit with a third resonant frequency, the third resonant frequency different than both the first and the second resonant frequencies.

The electronic device may further include a number N sets of additional passive circuitry in addition to the first passive circuitry; and a number N of additional second switch in addition to the first switch, each of the additional switches respectively having a first state and a second state, each of the additional switches selectively operable to electrically couple the respective one set of the additional passive circuitry across the antenna in the first state of the respective additional switch and to electrically decouple the respective set of additional passive circuitry from across the antenna in the second state of the respective additional switch, wherein, combinations of the antenna and the sets of passive circuitry provide at least $2^N$ possible passive EAS circuits selectable via the additional switches, each one of the passive EAS circuits having a respective resonant frequency different from the respective resonant frequency of the other ones of the passive EAS circuits. At least some of the additional switches may be operable to place the respective additional sets of passive circuitry concurrently electrically in parallel with one another across the antenna.

A method of operation in an electronic device including a set of circuitry, an antenna, a first passive circuitry, and a first switch having a first state and a second state, may be summarized as including in a first state of the first switch: electrically coupling the first passive circuitry across the antenna, wherein the antenna and the first passive circuitry form a passive electronic article surveillance (EAS) circuit with a first resonant frequency; and in a second state of the first switch: electrically decoupling the first passive circuitry from across the antenna; and electrically coupling the antenna with the set of circuitry, wherein the set of circuitry and the antenna form at least one of an inductive charger or a radio with a respective resonant frequency that is different from the first resonant frequency.

The electronic device further including a second passive circuitry and a second switch having a first state and a second state, may further include in the first state of the first switch: in a first state of the second switch, electrically coupling the second passive circuitry across the antenna, the antenna and the second passive circuitry forming a passive EAS circuit with a second resonant frequency, the second resonant frequency different than the first resonant frequency; and in a second state of the second switch, electrically decoupling the second passive circuitry from across the antenna.

The electronic device further including one or more proximity sensors, may further include receiving a signal from the one or more proximity sensors; and in response to receiving the signal from the one or more proximity sensors, changing the state of the first switch from the second state to the first state.

The electronic device further including one or more receivers, may further include receiving a signal at the one or more receivers; and in response to receiving the signal from the one or more receivers, changing the state of the first switch from the first state to the second state. The signal may include one or more security commands.

The electronic device further including an image sensor, may further include capturing an image of a machine-readable symbol with the image sensor; decoding the machine-readable symbol to obtain a command; and in response to the command, changing the state of the first switch from the first state to the second state.

A method of configuring a passive electronic article surveillance (EAS) functionality in an electronic device may be summarized as including providing a command to set at least a state of an EAS circuit in an electronic device; and setting a state of at least a first switch that has a first state and a second state, the first switch selectively operable to electrically couple a first passive circuitry across an antenna in the first state of the first switch and to electrically decouple the first passive circuitry from across the antenna in the second state of the first switch; wherein, in the first state of the first switch the antenna and the first passive circuitry form the EAS circuit with a first resonant frequency in the electronic device and in the second state of the first switch a set of circuitry and the antenna form in the electronic device at least one of an inductive charger or a radio with a respective resonant frequency that is different from the first resonant frequency. Providing a command may include wirelessly providing a command to turn ON or turn OFF the EAS functionality. Providing a command may include wirelessly providing a command to load a new set of processor-executable instructions. Providing a command may include wirelessly transmitting signals via a transmitter, the signals which encode the command. Providing a command may include providing an optically readable machine-readable symbol which encodes the command. Providing a command may include providing a command that changes a resonant frequency of the EAS circuit.

An electronic article surveillance (EAS) device may be summarized as including an antenna; a first passive circuitry; a first switch, the first switch selectively operable to repeatedly both electrically couple the first passive circuitry across the antenna to set a first resonant frequency for the EAS device, and electrically uncouple the first passive circuitry across the antenna to set a second resonant frequency for the EAS device.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1A:
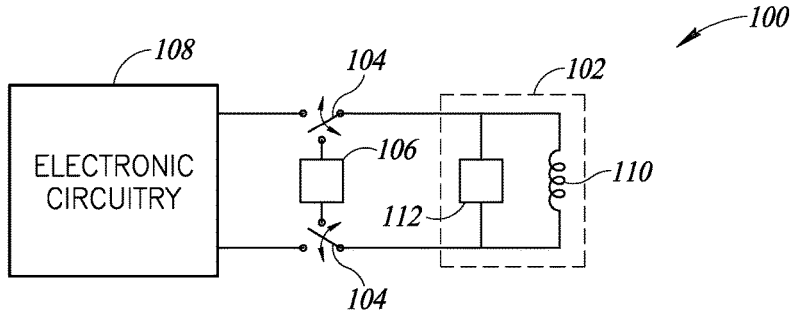
FIG. 1A is a schematic diagram of an EAS-capable circuit in which a switch is selectively operable to electrically couple an antenna to a passive circuitry in a first state and to electrically couple the antenna to a set of electronic circuitry in a second state, according to at least one illustrated implementation.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with scan engines, imagers, decoding circuitry, and/or machine-readable symbol readers have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

A smart electronic article surveillance ("EAS") circuit may be used to provide EAS functionality for an electronic device. In some implementations, a smart EAS-capable circuit may be incorporated into any number of electronic devices (e.g., portable communication devices, tablet computers, portable computers, machine-readable symbol readers, and other like devices) and may be used to selectively couple large electrical components, such as internal inductor coils, to various electrical components, circuits, or systems in the electronic device to thereby "share" the capabilities of such large components. By "sharing" or "re-using" the large electrical components across a number of different functionalities, the overall size and cost of the electronic device may be reduced. In some implementations, for example, the inductor coils used for wireless communication and/or for inductive charging may also be used to provide EAS capabilities for the electronic device. In such a situation, one or more software or solid-state switches may be used to selectively and repeatedly change between states corresponding to the wireless communication/inductive charging capabilities and the EAS capabilities. Accordingly, in such an implementation, the EAS capabilities may be activated in situations in which the electronic device may be at an increased risk of theft (e.g., when the electronic device is being used or placed on a sales floor), whereas the wireless communication/inductive charging capabilities may be activated in other, more secure locations (e.g., within a fixed holder or cradle for a machine-readable symbol reader, or behind a sales counter for other electronic goods) or after the electronic device has been purchased.

Figure 1B:
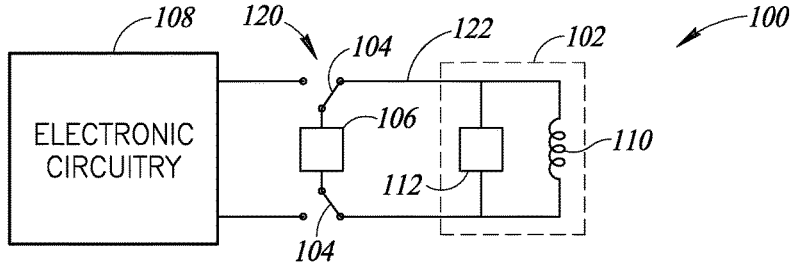
FIG. 1B is a schematic diagram of the EAS-capable circuit of FIG. 1 in which the switch has selectively, electrically coupled the antenna to the passive circuitry in the first state, according to at least one illustrated implementation.
Figure 1C:
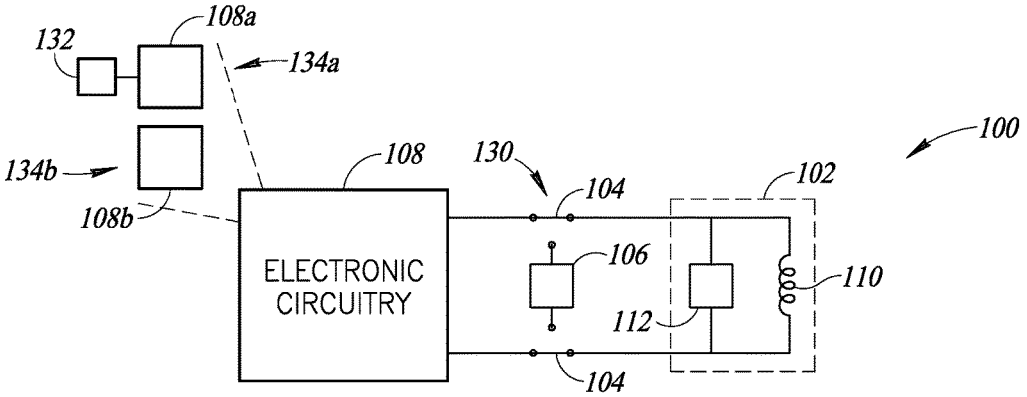
FIG. 1C is a schematic diagram of the EAS-capable circuit of FIG. 1 in which the switch has selectively, electrically coupled the antenna to the set of electronic circuitry in the second state, according to at least one illustrated implementation.

FIGS. 1A, 1B, and 1C shows an EAS-capable circuit 100 in which a switch 104 is selectively operable to electrically couple an antenna 102 to a first passive circuitry 106 in a first state 120 (FIG. 1B) and to a set of electronic circuitry 108 in a second state 130 (FIG. 1C). Such passive circuitry may include one or more capacitors, and may further include other passive elements such inductors, resistors, etc. The antenna 102 may be any type of component or set of components that have a resonant frequency. In some implementations, the antenna 102 may comprise an inductor 110 and one or more sets of passive circuitry (e.g., a second passive circuitry 112) to form an LC resonant circuit having a resonant frequency of:

$$f_0 = \frac{1}{2\pi\sqrt{LC}} \qquad \text{Eq. 1}$$

In Equation 1, L equals the inductance of the inductor 110, and C equals the capacitance of the second passive circuitry 112. In some implementations, the antenna 102 may comprise the inductor 110, the second passive circuitry 112, and one or more resistors (not shown) to form an RLC circuit having a resonant frequency provided by Equation 1. In some implementations, the antenna 102 may include just an inductor 110. In some implementations, as discussed below, the resonant frequency of the antenna 102 may be changed by selectively, electrically coupling one or more additional electrical components (e.g., capacitors) across the antenna 102.

The switches 104 may be any type of electrical component capable of selectively transitioning between a plurality of states to selectively couple one or more electrical components to the antenna 102. Although two switches 104 are shown in FIG. 1, such functionality discussed herein may be implemented using one switch, multiple switches, or like components (e.g., a demultiplexer). In some implementations, the switches 104 may be an electrical or electronic switch that changes between multiple states based upon one or more electrical input signals. Such an electronic switch may be, for example, a solid state relay and/or a solid state switch that has no moving parts. As such, an electronic switch may be quickly and repeatedly changed between states, and with no moving parts, suffer little, if any, resulting wear from the state change. In some implementations, the switches 104 may be a mechanical switch, such as a toggle switch, a set of push-button switches, or other similar such mechanical switches, which may be used to selectively transition between multiple states to thereby selectively couple one or more sets of electrical components to the antenna 102. Although the switches 104 shown in FIG. 1 have two states, a switch or switches having any number of states may be used.

In a first state 120 (FIG. 1B), the switches 104 selectively couple the second passive circuitry 106 across the antenna 102 to form a passive EAS circuit 122. The passive EAS circuit 122 may have a resonant frequency that may be determined according to Equation 1. Because the passive EAS circuit 122 is formed by electrically coupling the first passive circuitry 106 across the antenna 102, the resonant frequency of the passive EAS circuit 122 may differ from the resonant frequency of the antenna 102. In some implementations, the values of the inductor 110, the first passive circuitry 106, and the second passive circuitry 112 may be selected such that the passive EAS circuit 122 has a resonant frequency within the range of between about 1.75 MHz and 9.5 MHz. In some implementations, the values of the inductor 110, the first passive circuitry 106, and the second passive circuitry 112 may be selected such that the passive EAS circuit 122 has a resonant frequency of about 8.2 MHz.

In one implementation, for example, the value of the inductor 110 may be chosen to be about 2.2 μH and the value of the second passive circuitry 112 may be chosen to be about 80 pF, resulting in a resonant frequency of about 13.6 MHz for the antenna 102. Such a resonant frequency of 13.6 MHz may be used, for example, when the switches 104 are in the second state 130 and electrically couple the antenna 102 to the set of electronic circuitry 108 as discussed below to form a near field communication ("NFC") component. In such an implementation, the value of the first passive circuitry 106 may be chosen to be about 110 pF such that when the switches 104 are in the first state 120, the antenna 102 electrically couples to the first passive circuitry 106 to form the passive EAS circuit 122 having a resonant frequency of about 8.2 MHz.

In the second state 130, the switches 104 may electrically decouple the first passive circuitry 106 from the antenna 102. In some implementations, the switches 104 in the second state 130 may further couple the antenna 102 to the set of electronic circuitry 108 to provide additional functionality. For example, in some implementations, the set of electronic circuitry 108 may comprise a power supply circuit 108*a* and corresponding battery 132. In such an implementation, coupling the power supply circuit 108*a* with the antenna 102 may result in an inductive charger 134*a*. Charging the battery 132 may be accomplished, for example, using inductive charging in which the antenna 102 forms a receiver coil that inductively couples with a corresponding transmission coil (not shown). The transmission coil may be located, for example, within a charging pad, or within a holder or cradle that is sized and shaped to receive the electronic device and align the transmission coil and receiver coil (e.g., the antenna 102). Alternating a current flowing through the transmission coil may cause current to flow through the antenna 102, and such current may be used by the power supply circuit 108*a* to charge the battery 132. In such implementations, the values for the components of the antenna 102 (e.g., inductor 110 and second passive circuitry 112) may be selected such that the antenna 102 resonates at between 80 and 300 kHz and/or at about 6.78 MHz.

In some implementations, the set of electronic circuitry 108 may comprise a transceiver 108*b* (or separately, a receiver or a transmitter). In some implementations, the transceiver 108*b* may comprise a near field communication ("NFC") transceiver. In implementations in which the transceiver 108*b* is communicatively coupled to an NFC network, the values for the components of the antenna 102 (e.g., inductor 110 and second passive circuitry 112) may be selected such that the antenna 102 resonates at 13.56 MHz.

Figure 2:
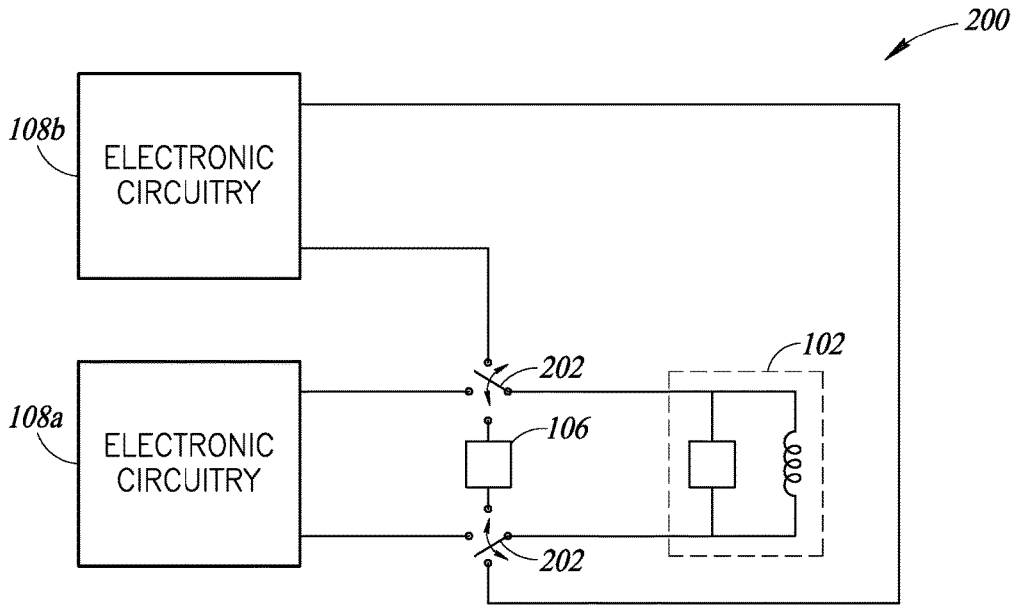
FIG. 2 is a schematic diagram of an EAS-capable circuit in which a switch is selectively operable to electrically couple an antenna to a passive circuitry in a first state, to electrically couple the antenna to a first set of electronic circuitry in a second state, and to electrically couple the antenna to a second set of electronic circuitry in a third state, according to at least one illustrated implementation.

FIG. 2 shows a configuration of an EAS-capable circuit 200 having a three-position switch 202 that is selectively operable to electrically couple an antenna 102 to the first passive circuitry 106 in a first state, to a first set of electronic circuitry (e.g., the power supply circuit 108*a*) in a second state, and to a second set of electronic circuitry (e.g., the transceiver 108*b*) in a third state, according to at least one illustrated implementation.

The switches 202 may be any type of electrical component capable of selectively transitioning between a plurality of states to selectively couple one or more electrical components to the antenna 102. Although two switches 202 are shown in FIG. 2, such functionality discussed herein may be implemented using one switch, multiple switches, or other like components. In some implementations, the switches 202 may be an electrical or electronic switch that changes between multiple states based upon one or more electrical input signals. Such an electronic switch may be, for example, a solid state relay and/or a solid state switch that has no moving parts. As such, an electronic switch may be quickly and repeatedly changed between states, and suffer little, if any, resulting wear from the state change. In some implementations, the switches 202 may be a mechanical switch, such as a toggle switch, a set of push-button switches, or other similar such mechanical switches, which may be used to selectively transition between multiple states to thereby selectively couple one or more sets of electrical components to the antenna 102. Although the switches 202 shown in FIG. 2 have three states, a switch or switches having any number of states may be used.

In some implementations, the switches 202 in the first state electrically couple the first passive circuitry 106 across the antenna 102 to form the passive EAS circuit 122. In the second state, the switches 202 may electrically couple the antenna 102 with the power supply circuit 108*a* to form an inductive charger. In the third state, the switches 202 may electrically couple the antenna 102 with the transceiver 108*b* to form a radio or transceiver. In at least some implementations, the power supply circuit 108*a* may include one or more electrical components (e.g., capacitors) that electrically couple across the antenna 102 when the switches 202 are in the second state to thereby change the resonant frequency of the antenna 102, for example. Such a change in resonant frequency may occur to enable the resonant frequency of the resulting inductive charger match the frequency of a transmission coil. In at least some implementations, the transceiver 108*b* may include one or more electrical components (e.g., capacitors) that electrically couple across the antenna 102 when the switches 202 are in the third state to thereby change the resonant frequency of the antenna 102, for example, to match a frequency of a wireless transmission network.

Figure 3:
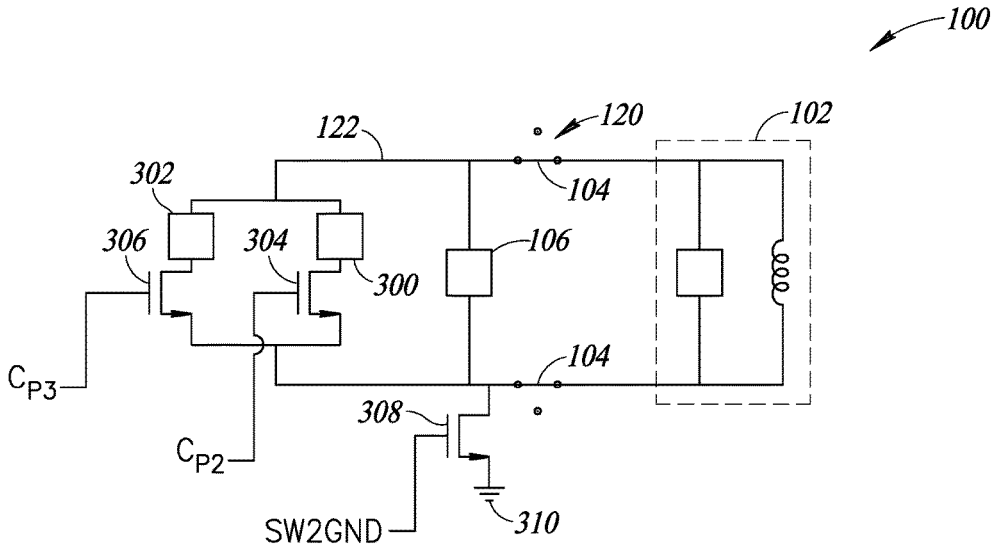
FIG. 3 is a schematic diagram of an EAS-capable circuit in which a switch has electrically coupled an antenna to three sets of passive circuitry, and in which two of such sets of passive circuitry may be selectively, electrically coupled across the antenna by using corresponding series switches, according to at least one illustrated implementation.

FIG. 3 shows the EAS-capable circuit 100 in which the switches 104 are in the first state 120 to form the passive EAS circuit 122, and in which two additional sets of passive circuitry (first optional passive circuitry 300 and second optional passive circuitry 302) may be selectively placed across the antenna 102, thereby changing the resonant frequency of the passive EAS circuit 122. In some implementations, the first optional passive circuitry 300 may be electrically coupled in series with a first series switch 304 that has a first state and a second state. Such a first series switch 304 may be, for example, a junction gate field-effect transistor (JFET), a metal-oxide-semiconductor field effect transistor (MOSFET), or any other similar electronic switch that may be used to electrically couple and electrically de-couple electrical components to a circuit. In the first state, the first series switch 304 may be operable to electrically couple the first optional passive circuitry 300 across the antenna 102, and thereby, change the resonant frequency of the passive EAS circuit 122. In the second state, the first series switch 304 may effectively be open and therefore operable to electrically decouple the first optional passive circuitry 300 from the antenna 102.

The second optional passive circuitry 302 may be electrically coupled in series with a second series switch 306 that has a first state and a second state. Such a second series switch 306 may be, for example, a junction gate field-effect transistor (JFET), a metal-oxide-semiconductor field effect transistor (MOSFET), or any other similar electronic switch that may be used to electrical couple and electrical de-couple electrical components. In the first state, the second series switch 306 may be operable to electrically couple the second optional passive circuitry 302 across the antenna 102, and thereby change the resonant frequency of the passive EAS circuit 122. In the second state, the second series switch 306 may effectively be open and therefore operable to electrically decouple the second optional passive circuitry 302 from the antenna 102.

The first optional passive circuitry 300 and the second optional passive circuitry 302 may be used individually and/or in combination to change the resonant frequency of the passive EAS circuit 122. Accordingly, in some implementations, for example, one or both of the first optional passive circuitry 300 and/or the second optional passive circuitry 302 may be electrically coupled across the antenna 102 and used to tune the resonant frequency of the passive EAS circuit 122. Such an implementation may be used, for example, to account for environmental, system-based, or other variations in the frequency of a waveform transmitted by a corresponding EAS transmitter such that the resonant frequency of the passive EAS circuit 122 may better match the frequency of a waveform emitted by an EAS transmitter. In some implementations, one or both of the first optional passive circuitry 300 and/or the second optional passive circuitry 302 may be used to choose between various EAS frequencies that may be used by different EAS systems. For example, in some implementations, one EAS barrier may transmit waveforms at 8.2 MHz and a second EAS barrier may transmit waveforms at 7.4 MHz. Thus, by choosing appropriate values for the first optional passive circuitry 300 and the second optional passive circuitry 302, and selectively placing one or both of the first optional passive circuitry 300 and the second optional passive circuitry 302 across the antenna 102, the passive EAS circuit 122 may be capable of selectively resonating at either of the frequencies of the two EAS barriers.

Any number N of additional, optional sets of passive circuitry may be selectively coupled to or de-coupled from the passive EAS circuit 122 using accompanying switches. The combinations of the antenna and the N sets of passive circuitry provide at least $2^N$ possible passive EAS circuits selectable via the additional N switches. Each of the $2^N$ passive EAS circuits may have a respective resonant frequency different from the respective resonant frequency of the other ones of the passive EAS circuits.

In some implementations, a third switch 308 may optionally be used to connect to ground 310 when the third switch 308 is in a first state. Such a connection to ground may be used, for example, to provide a ground reference to the passive EAS circuit 122. Such a ground reference may be advantageous, for example, when one or both of the first series switch 304 and the second series switch 306 is an n-channel MOSFET, to better ensure that the voltages applied to the gates of the first series switch 304 and the second series switch 306 are sufficient to place the first series switch 304 and/or the second series switch 306 in an OPEN state or CLOSED state as needed.

Figure 4:
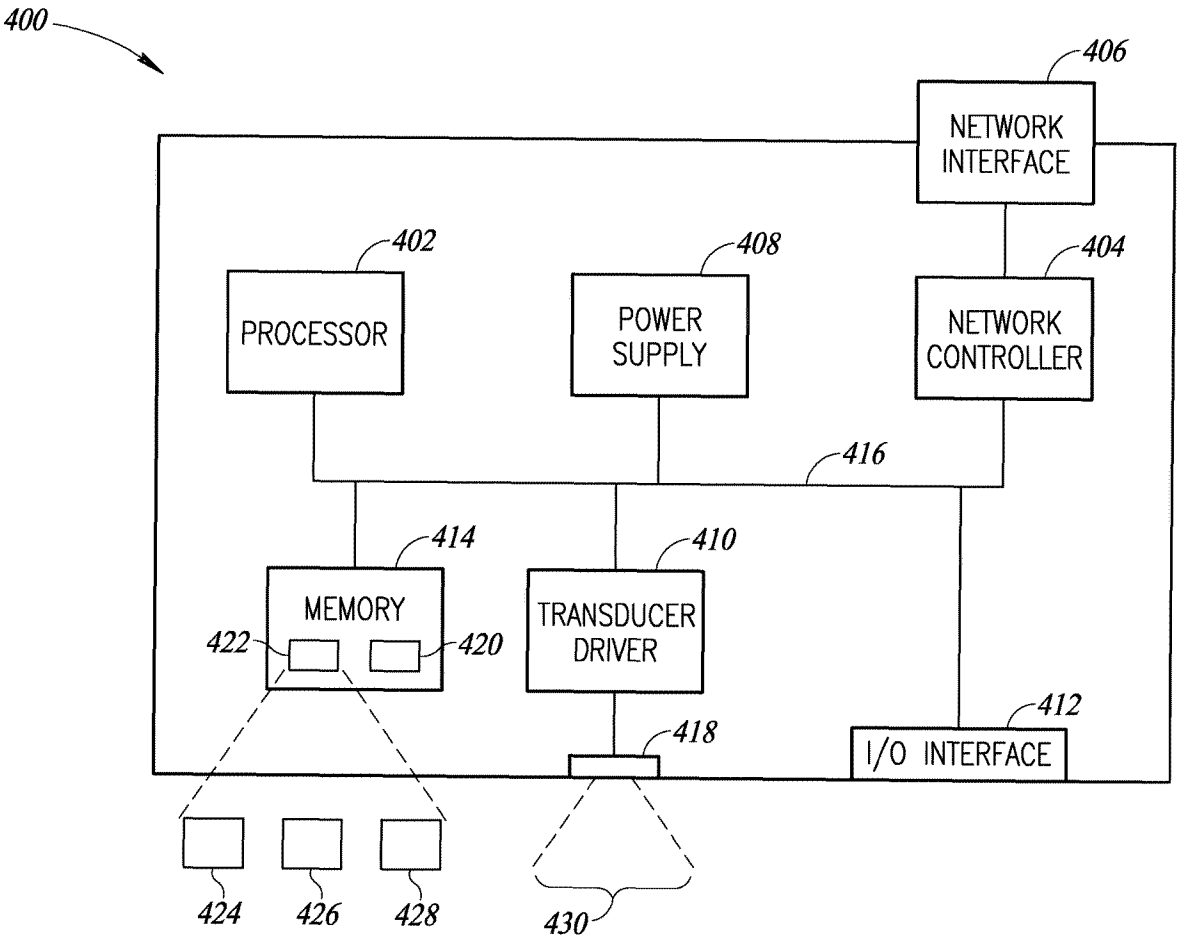
FIG. 4 is a block diagram of a control unit that may be used to control a smart EAS circuit, according to at least one illustrated implementation.

FIG. 4 shows a control unit 400 that may be used within the EAS-capable circuit 100, according to at least one illustrated implementation. The control unit 400 includes a processing unit 402, a network controller 404 and associated network interface 406, a power supply 408, a transducer driver 410, an input/output interface 412, and a system memory 414. Each of these components may be communicatively connected by bus(es) 416, which can provide bidirectional communication between the various components of the control unit 400. Bus(es) 416 may take, for example, the form of a plurality of buses (e.g., data buses, instruction buses, power buses) included in at least one body. The control unit 400 will at times be referred to in the singular herein, but this is not intended to limit the embodiments to a single system, since in certain embodiments, there will be more than one system or other networked computing device involved. Non-limiting examples of commercially available systems include, but are not limited to, an Atom, Pentium, or 80x86 architecture microprocessor as offered by Intel Corporation, a Snapdragon processor as offered by Qualcomm, Inc., a PowerPC microprocessor as offered by IBM, a Sparc microprocessor as offered by Sun Microsystems, Inc., a PA-RISC series microprocessor as offered by Hewlett-Packard Company, an A6 or A8 series processor as offered by Apple Inc., or a 68xxx series microprocessor as offered by Motorola Corporation.

The processing unit 402 for the control unit 400 may be any logic processing unit, such as one or more central processing units (CPUs), digital signal processors (DSPs), application-specific integrated circuits (ASICs), field programmable gate arrays (FPGAs), etc. The power supply 408 for the EAS-capable circuit 100 may include one or more power supplies 408, which provide electrical power to the various components of the EAS-capable circuit 100 via power connections. The power supply 408 may be an internal power supply, such as a battery, energy source, fuel cell, or the like. In some implementations, the power supply 408 may include the battery 132.

The control unit 400 may include a network controller 404 and associated network interface 406 to enable the EAS-capable circuit 100 to communicate with one or more communications or data networks. The network controller 404 may include one or more communications stacks to facilitate such network communication. Communications may be via the network interface 406 that includes a wired and/or a wireless network architecture to connect to, for instance, wired and wireless enterprise-wide computer networks, intranets, extranets, and/or the Internet. Other embodiments may include other types of communications networks including telecommunications networks, cellular networks, paging networks, and other mobile networks.

The control unit 400 may include one or more transducer drivers 410 that can be used to control one or more image sensors 418 that may be used to capture images or other information from the environment, such as, for example, those images that appear within an image-sensor field-of-view 430 of the image sensor 418. The control unit 400 may include one or more machine-readable symbol reader engines to optically read information from machine-readable symbols (e.g., one-dimensional or linear machine-readable symbols such as barcode symbols, two-dimensional machine-readable symbols, for instance Quick Response (QR) symbols, or the like). Such an image sensor 418 and one or more machine-readable symbol reader engines may be available, for example, when the EAS-capable circuit 100 is incorporated into a machine-readably symbol reader or other such device. In some implementations, such an image sensor 418 and one or more machine-readable symbol reader engines may be available, for example, when the EAS-capable circuit 100 is incorporated into a smartphone that has a camera available to capture an image and associated applications that may be used to optically read information from captured machine-readable images.

The control unit 400 may include an input/output interface 412. Such an input/output interface 412 may provide an electrical and/or communicative coupling between the control unit 400 and various other input and output components or devices. Such components, for example, may include navigation and/or location tracking equipment and applications, and may provide, for example, geo-location functionality (e.g., GPS and/or GLONASS capabilities) that determines coordinate information, and/or positional functionality that determines or estimates relative location (e.g., location relative to one or more cellular towers) that may be used to provide an absolute and/or a relative position of the EAS-capable circuit 100. In some implementations, the input/output interface 412 may be communicatively coupled to one or more of the switches 104 and 202, and/or the series switches (e.g., first series switch 304 and/or second series switch 306). In such an implementation, an output on the input/output interface 412 may include one or more electrical control signals that may be provided to one or more of the switches 104 and 202, and/or the series switches (e.g., first series switch 304 and/or second series switch 306). Such output signals may be used to control the state of one or more of such switches.

The control unit 400 may include a system memory 414 that may comprise a hard disk drive (HDD) for reading from and writing to a hard disk, an optical disk drive for reading from and writing to removable optical disks, a magnetic disk drive for reading from and writing to magnetic disks, and/or a solid-state drive (SSD). The optical disk can be a CD-ROM, while the magnetic disk can be a magnetic floppy disk or diskette. The hard disk drive, optical disk drive, and magnetic disk drive may communicate with the processing unit 402 via the system bus 416. Those skilled in the relevant art will appreciate that other types of computer-readable media that can store data accessible by a computer may be employed, such as WORM drives, RAID drives, magnetic cassettes, flash memory cards, digital video disks ("DVD"), RAMs, ROMs, smart cards, etc.

System memory 414 can be used to store data 420 as well as one or more programs, applications, or routines 422. For example, the system memory 414 may store instructions for an EAS deactivation application 424, instructions for one or more transition routines 426 to control transitions between various states, and/or instructions for implementing software updates 428.

The EAS deactivation application 424 may be executed, for example, in situations in which the passive EAS circuit 122 may be permanently disabled. Such a situation may arise, for example, when a customer purchases an electronic device at a retail location or establishment. In such a situation, the passive EAS circuit 122 may have been activated while the electronic device was on sale within the retail establishment to act as a theft deterrent in conjunction with a corresponding EAS barrier (as provided, for example, by an EAS transmitter and corresponding receiver). Once the item has been purchased, though, the risk of theft from the retail establishment no longer exists such that the functionality provided by the passive EAS circuit 122 may no longer be needed. In this situation, the passive EAS circuit 122 may be permanently disabled so that the other functionality provided, for example, by the inductive charger 134*a* and/or radio 134*b* may be permanently enabled for the convenience of the purchasing customer, such as, for example, by transitioning the switches 104 from the first state 120 to second state 130.

The EAS deactivation application 424 may disable the passive EAS circuit 122 in response to receiving one or more signals. In some implementations, for example, a sales person may scan a machine-readable symbol, which may be used to encode an appropriate command to deactivate the EAS capability. The image sensors 418 may capture such a symbol, which may be decoded by one or more machine-readable symbol reader engines. Upon decoding and processing the deactivation command, the instructions within the EAS deactivation application 424 may cause the switches 104 in the EAS-capable circuit 100 to transition to the second state 130, thereby decoupling the first passive circuitry 106 from the antenna 102. In some implementations, the network interface 406 may receive one or more signals from a wireless communications network that includes an appropriate command to deactivate the EAS capability. Such a signal may be requested, for example, by a sales person to deactivate the passive EAS circuit 122 upon receiving payment for the electronic device from the customer. In this situation, upon receiving and processing such a command, the instructions within the EAS deactivation application 424 may cause the switches 104 in the EAS-capable circuit 100 to transition to the second state 130, thereby decoupling the first passive circuitry 106 from the antenna 102.

In some implementations, the system memory 414 may store instructions for one or more transition routines 426 to control transitions of the switches 104, 202 between various states. Such states may include, for example, a state associated with a passive EAS circuit 122, a state associated with an inductive charger 134*a*, and/or a state associated with a radio 134*b* and/or transceiver. In some implementations, one or more input signals received by the EAS-capable circuit 100 may result in such a transition. For example, in some situations, signals received from one or more proximity sensors (e.g., RFID transceivers) and/or location sensors may cause the instructions executed by the transition routine 426 to transition the switches 104 to the second state 130. In such situations, the signal from the proximity sensors and/or location sensors may be generated when the electronic device containing the passive EAS circuit 100 is in a known location (e.g., such as a fixed holder or case used to support or hold the electronic device) or within a known geographic area (e.g., behind a service counter within a retail establishment) considered to be safe. In such a situation, the switches 104 may be in some state other than the first state 120 (e.g., the second state in the EAS-capable circuit 100, or the second or third states for the EAS-capable circuit 200) such that the EAS-capable circuit 100, 200 may provide non-EAS functionality. When the electronic device is moved from the known location and/or geographic area, the signals received from the proximity sensors and/or geo-location sensors may cause the transition routine 426 to transition the switches 104, 202 to the first state 120 corresponding to the passive EAS circuit 122. The switches 104, 202 may remain in the first state 120 until the electronic device is returned to the known location or geographic area. In such situation, the switches 104, 202 may repeatedly be switched between the various states (e.g., first state 120 and second state 130) as the need for the passive EAS circuit 122 arises.

In some implementations, the system memory 414 may store instructions for implementing software updates 428. Such software updates may be implemented, for example, to enable the switches 104, 202 to be in the first state 120 to implement the passive EAS circuit 122. In some situations, for example, a retailer may purchase or receive the electronic goods without the passive EAS functionality being enabled. Because the switches 104, 202 may be controlled via electric signals generated by the control unit 400, the functionality of the passive EAS circuit 122 may be enabled by updating the software to include, for example, one or more transition routines 426. In some situations, the instructions for implementing software updates 428 may be used to control and/or modify the resonant frequency or frequencies of the passive EAS circuit 122. Thus, for example, in some situations, the EAS-capable circuit 100 may include a plurality of optional sets of passive circuitry (e.g., first optional passive circuitry 300 and the second optional passive circuitry 302), only some of which may be used to control the resonant frequency (or frequencies) of the passive EAS circuit 122 with one software version. A software update, though, may enable others of the optional sets of passive circuitry to provide additional and/or alternative resonant frequencies.

Figure 5:
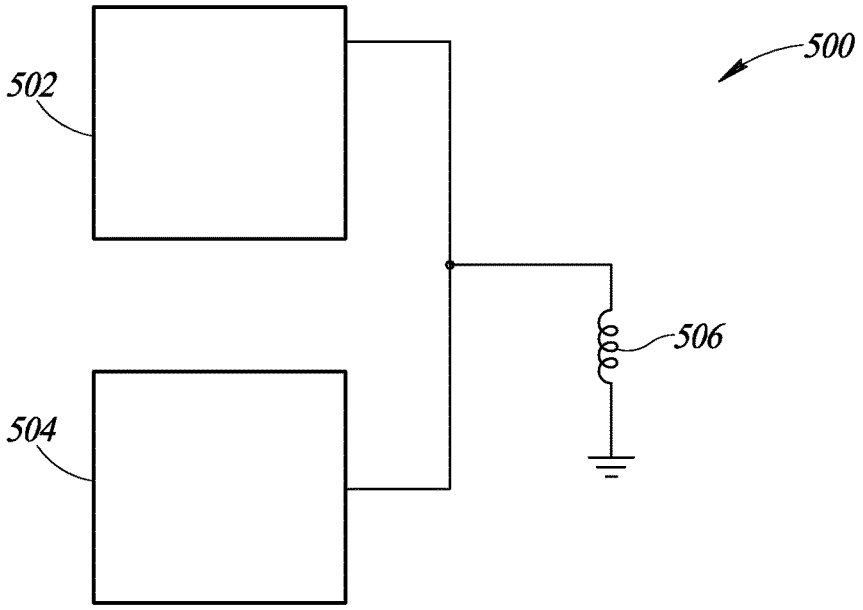
FIG. 5 is a schematic diagram of an EAS-capable circuit in which both EAS resonant circuitry and electronic circuitry from another component have been electrically coupled to an inductor, according to at least one illustrated implementation.

FIG. 5 shows an EAS-capable circuit 500 in which both EAS circuitry 502 and non-EAS electronic circuitry 504 from another component have been electrically coupled to an inductor 506, according to at least one illustrated implementation. The non-EAS electronic circuitry 504 may comprise a transceiver 108*b* that has a resonant frequency within a range, such as, for example, a range that may be used for NFC communication. In some implementations, the EAS circuitry 502 and the non-EAS circuitry 504 may use non-overlapping resonant frequencies to receive electromagnetic waveforms generated by other devices, including, for example, an EAS transmitter and/or an inductive charging transmitter and/or a NFC transmitter. In such an implementation, dual resonant circuits may be formed using the inductor 506. In such an implementation, each of the respective systems may resonate at very narrow, non-overlapping bands. As such, these systems may both be simultaneously connected to the inductor 506. In some implementations, each of the EAS circuitry 502 and the non-EAS electronic circuitry 504 may take into account the fact that the other circuit (e.g., the non-EAS electronic circuitry 504 and the EAS circuitry 502, respectively) is coupled to the inductor 506. As such, each of the EAS circuitry 502 and the non-EAS electronic circuitry 504 may influence the frequency response of the other circuit. As a result, each of the EAS circuitry 502 and the non-EAS electronic circuitry 504 may be resonant at different frequencies and both the EAS circuitry 502 and the non-EAS electronic circuitry 504 may work simultaneously.

In some implementations, each of the EAS circuitry 502 and the non-EAS electronic circuitry 504 may be deactivated, via, for example, a switch. Disconnecting one of the EAS circuitry 502 and the non-EAS electronic circuitry 504, however, may impact the resonant frequency of the other circuit, resulting, for example, in the other circuit possibly resonating at the wrong frequency. As such, a switch may be use to connect the EAS circuit 502 or the non-EAS electronic circuit 504 to a compensation circuit in order to get the EAS circuitry 502 or the non-EAS electronic circuitry 504 to be resonant at a desired frequency even when the other circuit is disconnected.

Figure 6:
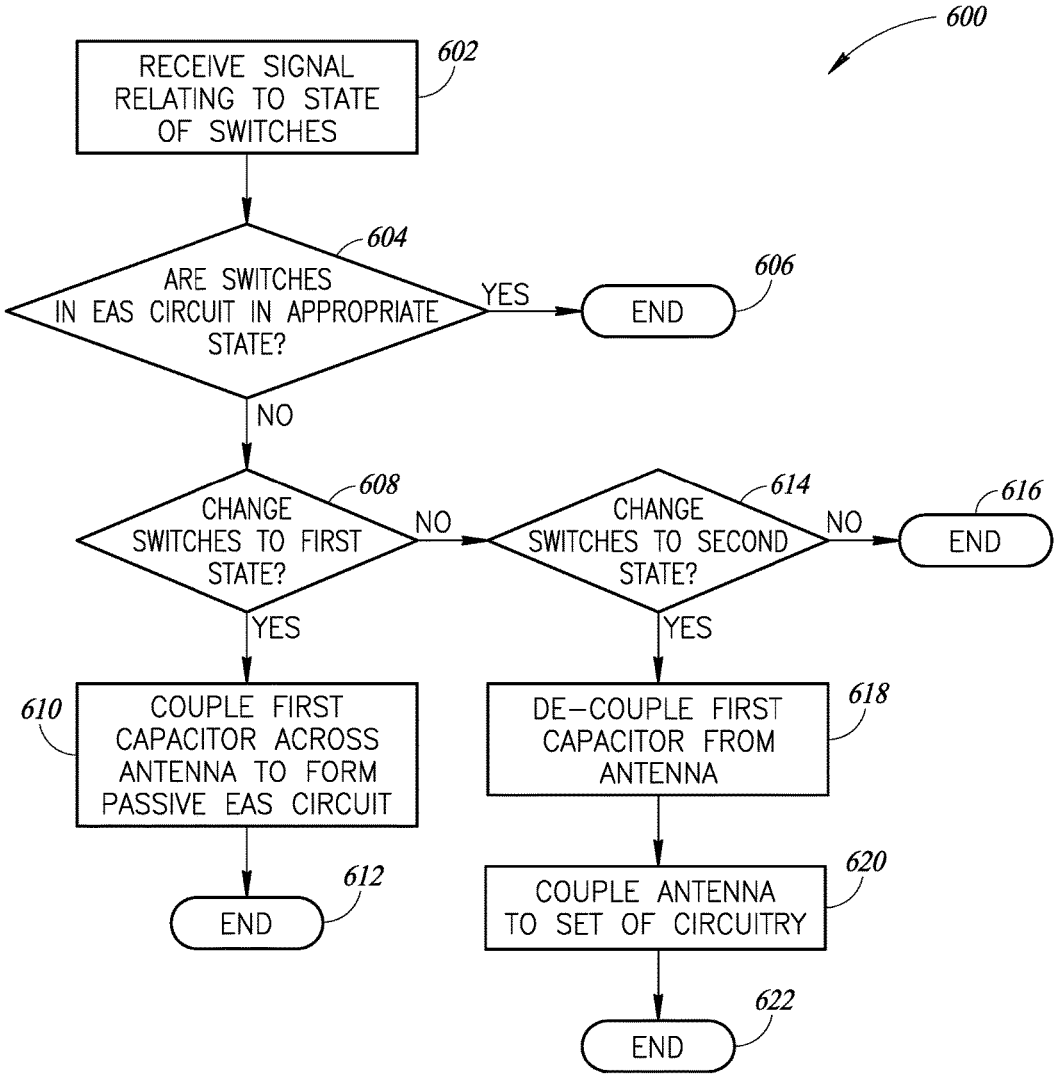
FIG. 6 is a logic flow diagram of operating an EAS-capable circuit with a first switch having a first state and a second state, according to at least one illustrated implementation.

FIG. 6 shows a method 600 of operating an EAS-capable circuit 100 with a first switch 104 having a first state 120 corresponding to a passive EAS circuit 122 and a second state 130 corresponding to functionality provided by a set of electronic circuitry 108, according to at least one illustrated implementation. Some or all of the method 600 may be implemented, for example, via the instructions for one or more transition routines 426.

At 602, the EAS-capable circuit 100 receives a signal related to the state of the switches 104, 202. In some implementations, such a signal may be received from one or more sensors, such as a proximity sensor or a location sensor. Upon receiving and processing such a signal, the processing unit 402 may execute one or more instructions (e.g., the instructions in the one or more transition routines 426, as discussed above) that result in a state for the switches 104, 202 corresponding to the received signal being identified.

For example, in some situations, a signal received from a proximity sensor and/or location sensor may indicate that the electronic device containing the EAS-capable circuit 100 has been removed from a known location or geographic area. In such a situation, the instruction executed by the processor may indicate that the switches 104, 202 in the EAS-capable circuit 100 should be in the first state 120 corresponding to the passive EAS circuit 122. Similarly, in some situations, the signal received from a proximity sensor and/or location sensor may indicate that the electronic device containing the EAS-capable circuit 100 has been moved into a known location or geographic area. In such a situation, the instruction executed by the processor may indicate that the switches 104, 202 in the EAS-capable circuit 100 should be in the second state 130 corresponding to the non-EAS circuit 134.

In some implementations, the signal may include one or more commands indicating that the passive EAS circuit 122 should be disabled and/or deactivated. In some implementations, for example, such a signal may be generated when a customer purchases an item at a retail establishment such that the EAS capabilities provided by the passive EAS circuit 122 may no longer be necessary. In such a situation, the signal deactivating the EAS functionality may be encoded in a machine-readable symbol that is captured by the image sensor 418 and decoded by a machine-readable symbol reader engine. Alternatively or in addition, the signal deactivating the EAS functionality may be encoded within a wireless signal that is received via the network interface 406.

At 604, the processing unit 402 determines if the switches 104, 202 are in the identified state. If the switches 104, 202 of the EAS-capable circuit 100 are in the correct state, then the method 600 ends at 606. If the switches 104, 202 of the EAS-capable circuit 100 are not in the correct state, then the method 600 transitions to 608.

At 608, the processing unit 402 determines if the switches 104, 202 should be transitioned to the first state 120 corresponding to the passive EAS circuit 122. If so, then the method 600 transitions to 610. If not, then the method 600 transitions to 614.

At 610, the switches 104, 202 are transitioned to the first state 120 in which the first passive circuitry 106 is coupled across the antenna 102, thereby forming the passive EAS circuit 122. Such a passive EAS circuit 122 may resonate at a frequency that corresponds to the frequency of the waveforms emitted by corresponding EAS transmitters used to form an EAS barrier that may be implemented, for example, in an enclosed retail space. The process then transitions to and ends at 612.

At 614, the processing unit 402 determines if the switches 104, 202 should be transitioned to the second state 130 corresponding to the non-EAS circuit 134. If so, then the method 600 transitions to 618. If not, then the method 600 transitions to and ends at 616.

At 618, the first passive circuitry 106 is de-coupled from the antenna 102. Such a de-coupling may be effected, for example, by transitioning the switches 104, 202 away from the first state 120.

At 620, the switches 104, 202 are transitioned to the second state 130 in which the set of electronic circuitry 108 is coupled across the antenna 102, thereby forming the non-EAS circuit 134. Such a non-EAS circuit 134 may include, for example, inductive charger 134*a* and/or a radio 134*b*. In some implementations, one or more optional sets of passive circuitry (e.g., first optional passive circuitry 300 and/or second optional passive circuitry 302) may be electrically coupled across the antenna 102 to achieve the desired resonant frequency. The process then transitions to and ends at 622.

Figure 7:
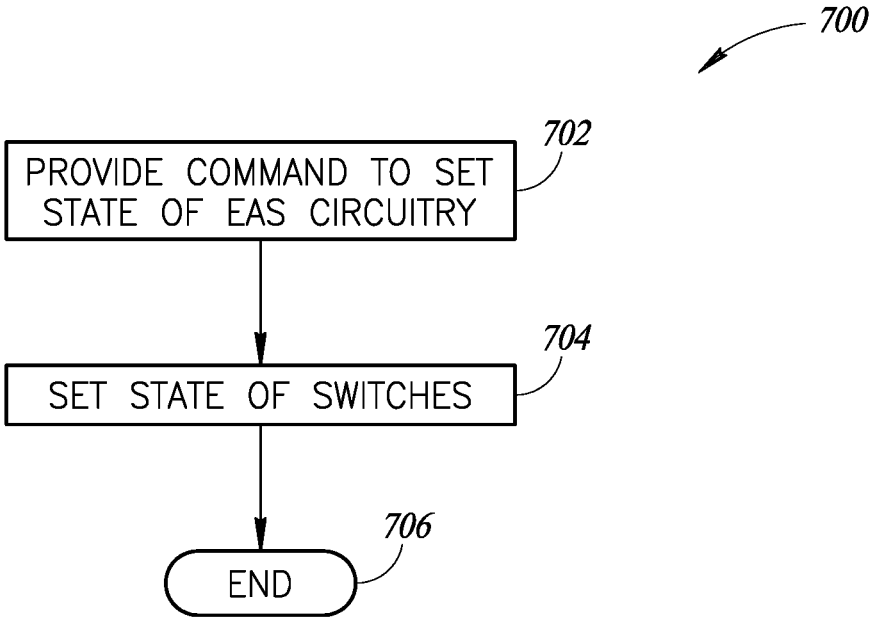
FIG. 7 is a logic flow diagram of providing commands to configure a passive EAS functionality in an electronic device, according to at least one illustrated implementation.

FIG. 7 shows a method 700 of providing commands to configure a passive EAS circuit 122 in an electronic device, according to at least one illustrated implementation. Some or all of the method 700 may be implemented, for example, via the instructions for one or more transition routines 426 and/or the instructions for implementing software updates 428.

At 702, a command is provided to set the state of the EAS-capable circuit 100. Such states, which may be set using the switches 104, 202, may include a state corresponding to a passive EAS circuit 122 and a state or states corresponding to one or more non-EAS circuits 134 (such as an inductive charger 134*a* and/or a radio 134*b*). In some implementations, the command may be wirelessly received via the network interface 406. In some implementations, the command may be encoded within a machine-readable symbol that is captured by the image sensors 418 and decoded by the machine-readable image decoder engines. In some implementations, the command provided may specify that the EAS functionality should be turned to an ON state in which the switches 104 electrically couple the antenna 102 and the passive circuitry 106 to form the passive EAS circuit 122, or to an OFF state in which, for example, the switches 104 decouple the passive circuitry 106 from the antenna 102.

In some implementations, the command provided at 702 may specify other functionalities. For example, in some implementations, the command provided at 702 may result in a new set of processor-executable instructions being loaded into the memory 414. In some implementations, the command provided at 702 may result in changing the resonant frequency of the passive EAS circuit 122, such as, for example, by activating or deactivating one or more series switches (e.g., first series switch 304 and/or second series switch 306) associated with one or more optional sets of passive circuitry (e.g., first optional passive circuitry 300 and/or second optional passive circuitry 302).

At 704, the processing unit 402 sets the states of the switches 104, 202. In the first state 120, the switches 104, 202 couple the passive circuitry 106 to the antenna 102 thereby forming the passive EAS circuit 122. In the second state 130, the switches 104, 202 de-couple the passive circuitry 106 from the antenna 102. In addition, or alternatively, the switches 104, 202 in the second state 130 may couple the electronic circuitry 108 and the antenna 102, thereby forming, for example, an inductive charger 134*a* or a radio 134*b*. The method 700 ends at 706.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one implementation, the present subject matter may be implemented via Application Specific Integrated Circuits (ASICs). However, those skilled in the art will recognize that the implementations disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

Those of skill in the art will recognize that many of the methods or algorithms set out herein may employ additional acts, may omit some acts, and/or may execute acts in a different order than specified.

In addition, those skilled in the art will appreciate that the mechanisms taught herein are capable of being distributed as a program product in a variety of forms, and that an illustrative implementation applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. An electronic device, comprising:

a set of circuitry, the set of circuitry comprising at least one of: a power supply circuit that provides wireless charging of a battery, or a transceiver, transmitter or receiver that provides wireless communications;

an antenna;

a first passive circuitry; and a first switch having a first state, a second state, and a third state, the first switch selectively operable to electrically couple the first passive circuitry across the antenna in the first state of the first switch and to electrically decouple the first passive circuitry from across the antenna in the second state of the first switch, wherein, in the first state of the first switch the antenna and the first passive circuitry form a passive electronic article surveillance (EAS) circuit with a first resonant frequency and in the second state of the first switch the set of circuitry and the antenna form at least one of an inductive charger or a radio with a respective second resonant frequency that is different from the first resonant frequency, and wherein in the third state of the first switch the set of circuitry and the antenna form at least one of an inductive charger or a radio with a third respective resonant frequency that is different from the first resonant frequency and the second resonant frequency.

2. The electronic device of claim 1 wherein the first resonant frequency is in a range from 1.75 MHz to 9.5 MHz.

3. The electronic device of claim 2 wherein the second resonant frequency is in a range from 80 kHz to 300 kHz.

4. The electronic device of claim 1 wherein the set of circuitry comprises a near field communications (NFC) receiver that provides authentication of transactions with other electronic devices.

5. The electronic device of claim 1 wherein the set of circuitry comprises a near field communications (NFC) integrated circuit.

6. The electronic device of claim 1 wherein the second resonant frequency is about 13.56 MHz.

7. The electronic device of claim 1, further comprising: the battery.

8. The electronic device of claim 7 wherein the second resonant frequency is in a range from 80 kHz to 300 kHz.

9. The electronic device of claim 1, further comprising:

a second passive circuitry; and a second switch having a first state and a second state, the second switch selectively operable to electrically couple the second passive circuitry across the antenna in the first state of the second switch and to electrically decouple the second passive circuitry from across the antenna in the second state of the second switch, wherein, when the first switch is in the first state and the second switch is in the first state the antenna and the first passive circuitry and the second passive circuitry form a passive EAS circuit with a fourth resonant frequency, the fourth resonant frequency different than the first resonant frequency, the second resonant frequency, and the third resonant frequency.

10. The electronic device of claim 9, further comprising:

a third passive circuitry; and a third switch having a first state and a second state, the third switch selectively operable to electrically couple the third passive circuitry across the antenna in the first state of the second switch and to electrically decouple the third passive circuitry from across the antenna in the second state of the third switch, wherein, when the first switch is in the first state, the second switch is in the first state, and the third switch is in the first state, the antenna and the first passive circuitry, the second passive circuitry, and the third passive circuitry form a passive EAS circuit with a fifth resonant frequency, the fifth resonant frequency different than the first resonant frequency, the second resonant frequency, the third resonant frequency, and the fourth resonant frequency.

11. An electronic device, comprising:

a set of circuitry, the set of circuitry comprising at least one of: a power supply circuit that provides wireless charging of a battery, or a transceiver, transmitter or receiver that provides wireless communications;

an antenna;

a first passive circuitry;

a first switch having a first state and a second state, the first switch selectively operable to electrically couple the first passive circuitry across the antenna in the first state of the first switch and to electrically decouple the first passive circuitry from across the antenna in the second state of the first switch, wherein, in the first state of the first switch the antenna and the first passive circuitry form a passive electronic article surveillance (EAS) circuit with a first resonant frequency and in the second state of the first switch the set of circuitry and the antenna form at least one of an inductive charger or a radio with a respective second resonant frequency that is different from the first resonant frequency;

a number N of additional sets of passive circuitry in addition to the first passive circuitry; and a number N of additional second switch in addition to the first switch, each of the additional switches respectively having a first state and a second state, each of the additional switches selectively operable to electrically couple the respective one set of the additional passive circuitry across the antenna in the first state of the respective additional switch and to electrically decouple the respective one set of additional passive circuitry from across the antenna in the second state of the respective additional switch, wherein, combinations of the antenna and the sets of passive circuitry provide at least $2^N$ possible passive EAS circuits selectable via the additional switches, each one of the passive EAS circuits having a respective resonant frequency different from the respective resonant frequency of the other ones of the passive EAS circuits.

12. The electronic device of claim 11 wherein at least some of the additional switches are operable to place the respective additional sets of passive circuitry concurrently electrically in parallel with one another across the antenna.

13. A method of operation in an electronic device comprising a set of circuitry, an antenna, a first passive circuitry, a second passive circuitry, a first switch having a first state and a second state, and a second switch having a first state and a second state, the method comprising:

in a first state of the first switch:

electrically coupling the first passive circuitry across the antenna, wherein the antenna and the first passive circuitry form a passive electronic article surveillance (EAS) circuit with a first resonant frequency;

in a first state of the second switch, electrically coupling the second passive circuitry across the antenna, the antenna and the second passive circuitry forming a passive EAS circuit with a second resonant frequency, the second resonant frequency different than the first resonant frequency; and in a second state of the second switch, electrically decoupling the second passive circuitry from across the antenna; and in a second state of the first switch:

electrically decoupling the first passive circuitry from across the antenna; and electrically coupling the antenna with the set of circuitry, wherein the set of circuitry and the antenna form at least one of an inductive charger or a radio with a respective resonant frequency that is different from the first resonant frequency.

14. The method of claim 13 wherein the electronic device further comprises one or more proximity sensors, the method further comprising:

receiving a signal from the one or more proximity sensors; and in response to receiving the signal from the one or more proximity sensors, changing the state of the first switch from the second state to the first state.

15. The method of claim 13 wherein the electronic device further comprises one or more receivers, the method further comprising:

receiving a signal at the one or more receivers; and in response to receiving the signal from the one or more receivers, changing the state of the first switch from the first state to the second state.

16. The method of claim 15 wherein the signal includes one or more security commands.

17. The method of claim 13 wherein the electronic device further comprises an image sensor, the method further comprising:

capturing an image of a machine-readable symbol with the image sensor;

decoding the machine-readable symbol to obtain a command; and in response to the command, changing the state of the first switch from the first state to the second state.

* * * * *